US008180250B2

(12) United States Patent
Yang

(10) Patent No.: US 8,180,250 B2
(45) Date of Patent: May 15, 2012

(54) DRIVING DEVICE FOR TONER CARTRIDGE FOR USE IN PRINTING APPARATUS

(76) Inventor: Chao Chan Yang, Changhua County (TW)

( * ) Notice: Subject to any disclaimer, the term of this patent is extended or adjusted under 35 U.S.C. 154(b) by 52 days.

(21) Appl. No.: 12/470,664

(22) Filed: May 22, 2009

(65) Prior Publication Data

US 2010/0296840 A1 Nov. 25, 2010

(51) Int. Cl.
*G03G 15/00* (2006.01)
*G03G 21/16* (2006.01)

(52) U.S. Cl. ..... 399/111; 399/167

(58) Field of Classification Search ..... 399/111, 399/113, 117, 167
See application file for complete search history.

(56) References Cited

U.S. PATENT DOCUMENTS 5,132,732 A * 7/1992 Kalyandurg et al. ..... 399/119
5,528,343 A * 6/1996 Tada et al. ..... 399/113
6,125,253 A * 9/2000 Tashima et al. ..... 399/167
6,608,980 B2 * 8/2003 Murayama et al. ..... 399/111
7,327,970 B2 * 2/2008 Moon ..... 399/111
7,822,364 B2 * 10/2010 Takigawa et al. ..... 399/167

FOREIGN PATENT DOCUMENTS

JP 02097970 A * 4/1990
JP 02304576 A * 12/1990

* cited by examiner

*Primary Examiner* — Robert Beatty
(74) *Attorney, Agent, or Firm* — Alan Kamrath; Kamrath IP Lawfirm, PA

(57) ABSTRACT

A driving device for a toner cartridge includes a cartridge body and a driving portion disposed on the cartridge body. A transmission mechanism is disposed in the cartridge body. The driving portion includes a driving motor and a controller. The controller receives signal transmitted from a controller unit of a printing apparatus to precisely control the operation of the driving motor. The driving motor is connected with the transmission mechanism. Through the driving action of the driving portion, the transmission load of the printing apparatus can be reduced, and the stability of the printing system can be improved. Moreover, because the driving portion is built in the cartridge body, the gear transmission mechanisms of both of the printing apparatus and the toner cartridge can be simplified, and malfunction can be solved.

5 Claims, 5 Drawing Sheets

DRIVING DEVICE FOR TONER CARTRIDGE FOR USE IN PRINTING APPARATUS

BACKGROUND OF THE INVENTION

1. Field of the Invention

The present invention generally relates to a driving device for a toner cartridge, and more particularly to a built-in driving device for a toner cartridge for use in a printing apparatus, such as a laser printer, a copy machine, a xerographic device, etc.

2. The Prior Arts

FIG. 1 is a schematic view showing a conventional transmission mechanism for a toner cartridge that is compatible with laser printers, photocopiers, xerographic devices, etc. As shown, the conventional transmission mechanism 3 is provided at one side of a toner cartridge body 20, and is adapted to transmit movement to a gear assembly disposed inside of the cartridge body 20 for performing various printing operations. More specifically, the transmission mechanism 3 includes a transmission tenon 32 provided at one side of the cartridge body 20. The transmission tenon 32 includes a coupling end 321 having a polygonal shape and adapted to couple with a transmission sleeve 31 provided in a printing apparatus, such as a laser printer or a xerographic device. The transmission sleeve 31 has a coupling groove 311 that is adapted to engage with the coupling end 321 to transmit movement to the component parts in the toner cartridge for performing various printing actions.

When the toner cartridge is going to be mounted in the printing apparatus, the triangular coupling end 321 has to be aligned with the coupling groove 311 to properly engage the transmission tenon 32 with the transmission sleeve 31. If the triangular coupling end 321 is not aligned with the coupling groove 311, it needs to rotate the triangular coupling end 321 to be aligned with the coupling groove 311. However, when the triangular coupling end 321 is rotated, the triangular coupling end 321 of the transmission tenon 32 is pressed against the transmission sleeve 31, which results in wear. Moreover, the cross section of the triangular coupling end 321 is relatively large, which results in more wear. Therefore, it is inconvenient to replace the toner cartridge and it is also troublesome to solve the malfunction. In addition, because the shape of the coupling end 321 is triangle, the maximum angle, which the coupling end 321 needs to rotate to be aligned with the coupling sleeve 311, is 120 degrees. As a result, before the coupling end 321 is rotated to an engaging position, substantial frictional wear may occur during rotation, which increases the occurrence of damage in use, increases the driving load of the printing apparatus, and makes it less stable in operation. In addition, the transmission mechanism 3 of the printing apparatus uses gears for transmission. The toner cartridge is usually made of plastic that is not stiff enough. Owing to the complex gear engagement and the material property, the driving force of the printing apparatus can not be fully transmitted to the cartridge, adversely affecting the printing quality.

SUMMARY OF THE INVENTION

The primary objective of the present invention is to provide a driving device for a toner cartridge for use in a printing apparatus that is able to simplify the transmission mechanisms of both of the printing apparatus and the toner cartridge, to provide more precise control, to reduce driving load of the printing apparatus, and to improve stability during printing.

The solution of the present invention is to provide a driving device for a toner cartridge for use in a printing apparatus, which includes a cartridge body and a driving portion disposed on the cartridge body. The driving portion connects with a transmission mechanism disposed in the cartridge body. The driving portion includes a driving motor and a controller electrically connected with the driving motor. The driving motor and the printing apparatus are connected to each other through signal terminals for transmitting control signals for controlling the operation of the driving motor and for performing printing operations. Through the driving action of the driving portion, the transmission load of the printing apparatus can be reduced, and the stability of the printing system can be improved. Moreover, because the driving portion is disposed on the cartridge body, the gear transmission mechanisms of both of the printing apparatus and the toner cartridge can be simplified, and malfunction can be easily solved.

BRIEF DESCRIPTION OF THE DRAWINGS

The present invention will be apparent to those skilled in the art by reading the following detailed description of a preferred embodiment thereof, with reference to the attached drawings, in which.

DETAILED DESCRIPTION OF THE PREFERRED EMBODIMENTS

Figure 1:
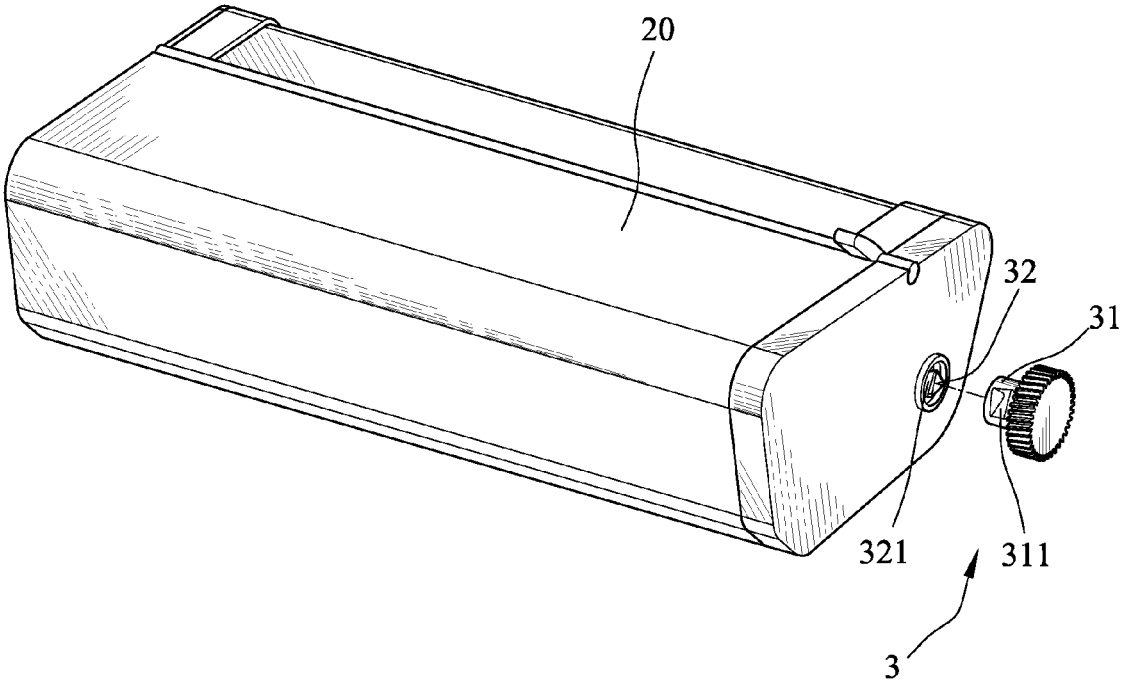
Fig. 1 (Prior Art)
FIG. 1 is a schematic view showing a conventional toner cartridge.
Figure 2:
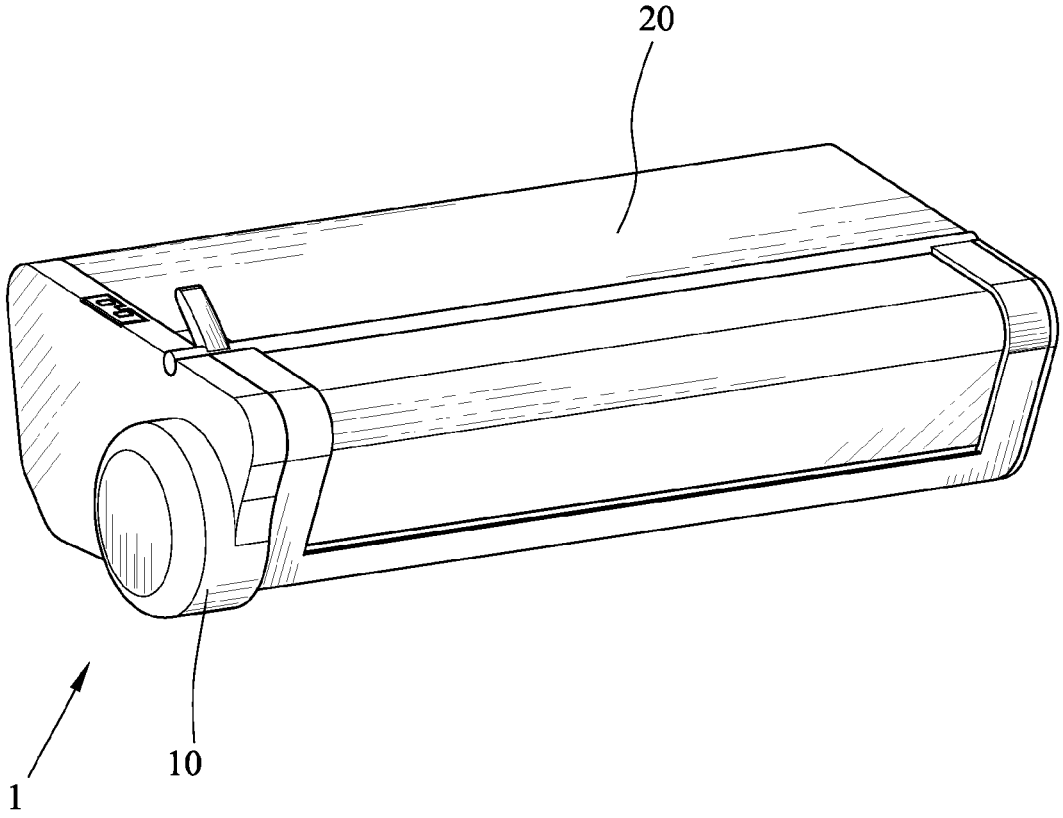
FIG. 2 is a perspective view showing a built-in driving device for a toner cartridge for use in a printing apparatus according to a first embodiment of the present invention.
Figure 3:
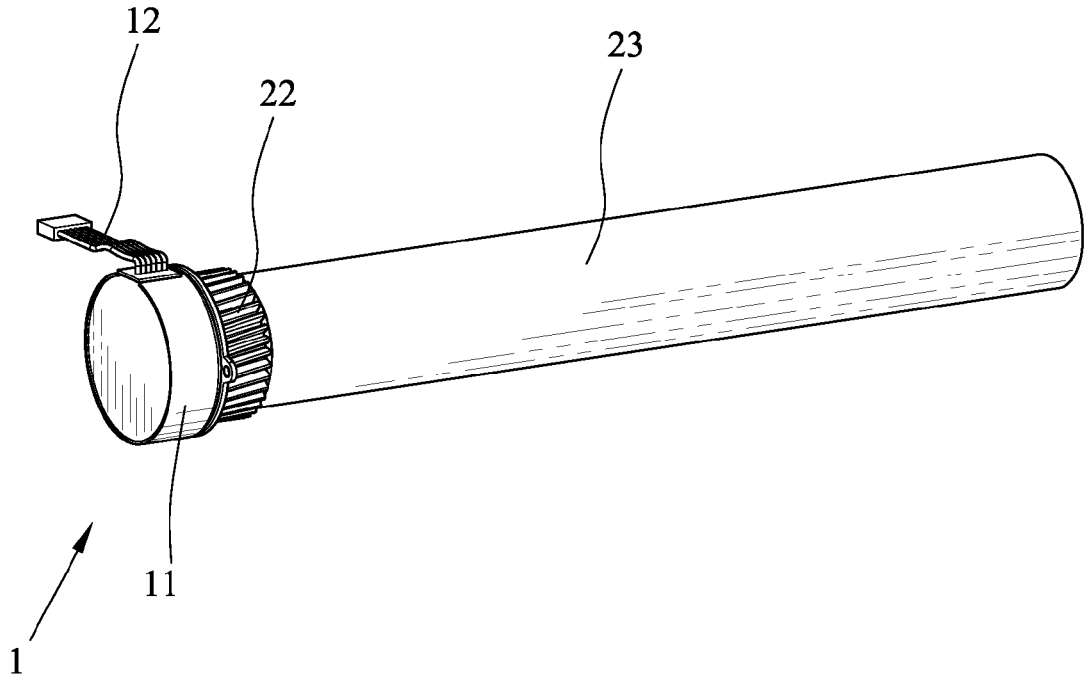
FIG. 3 is a perspective view showing a motor connected with a gear and an imaging drum according to the first embodiment of the present invention.
Figure 4:
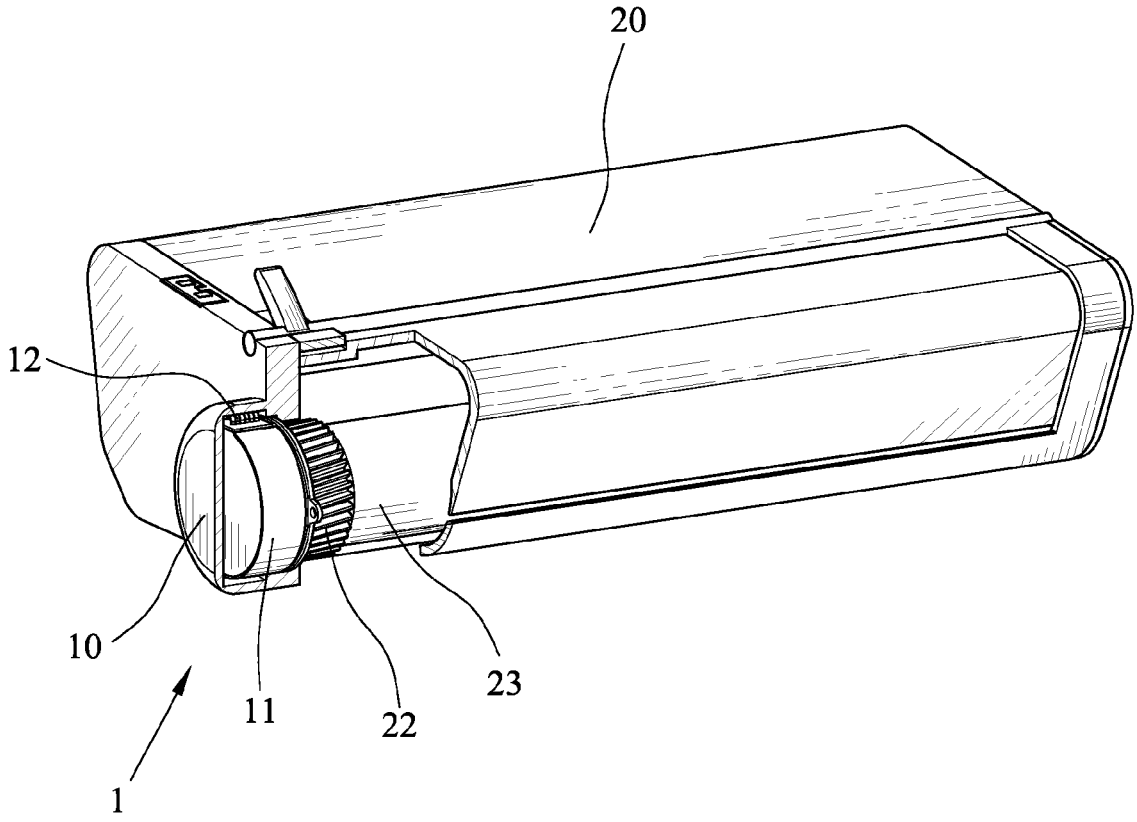
FIG. 4 is a partially cut-away view showing the driving device of FIG. 2.

Referring to FIGS. 2, 3 and 4, a driving device 1 is built in a toner cartridge according to a first embodiment of the present invention. The toner cartridge is used in a printing apparatus, such as a printer, a copy machine, a xerographic device, etc. The driving device 1 includes a cartridge body 20 and a driving portion 10 disposed at a side of the cartridge body 20. The driving portion 10 includes at least one driving motor 11 and a controller 12, and the cartridge body 20 includes a transmission mechanism and an imaging drum 23 disposed therein. The transmission mechanism according to the first embodiment includes a gear 22. The driving motor 11 is coupled with a first side the gear 22. Thus, the driving motor 11 drives the gear 22 and then the gear 22 drives other components disposed inside of the cartridge body 20 to move. The imaging drum 23 is coupled with a second side of the gear 22 and driven to move by the gear 22. Alternatively, the gear 22 may be connected with other members of the transmission mechanism, and then the members drive the imaging drum 23 to move. The controller 12 is electrically connected with the driving motor 11 and provided with signal terminals or signal cables. After the toner cartridge is assembled with the printing apparatus, the signal terminals or the signal cables of the controller 12 are connected with a controller unit (not shown in figures) of the printing apparatus. Control signals can thereby be transmitted to and received from the printing apparatus to drive and control the operation of the driving motor 11. Therefore, the complex design of the conventional transmission mechanism for the toner cartridge can be simplified.

Because the driving motor 11 is directly connected with the gear 22 to drive the diverse components in the toner cartridge, the components in the toner cartridge do not need to be driven by the printing apparatus through a series of transmission. As a result, the gear transmission mechanism in the toner cartridge can be simplified, and therefore power transmission loss is reduced. Moreover, through signal transmission between the controller 12 and the controller unit in the printing apparatus, the rotation speed and output torque of the driving motor 11 can be directly adjusted in a timely manner according to the printing needs. In addition, because the built-in driving device 1 includes the driving portion 10, the printing apparatus does not need to drive the toner cartridge through a complex transmission mechanism. Thus, the driving load of the printing apparatus is reduced. Because the driving force does not need to go through the complex transmission mechanism, the stability of the printing is improved.

A driving device 1 for a toner cartridge according to a second embodiment of the present invention is similar to the first embodiment. According to the second embodiment, the driving motor 11 is coupled with the imaging drum 23 and therefore the imaging drum 23 is directly driven by the driving motor 11. Then, the imaging drum 23 connected with the transmission mechanism of the cartridge body 20, such as the gear 22. The gear 22 drives other components disposed inside of the cartridge body 20 to move.

Figure 5A:
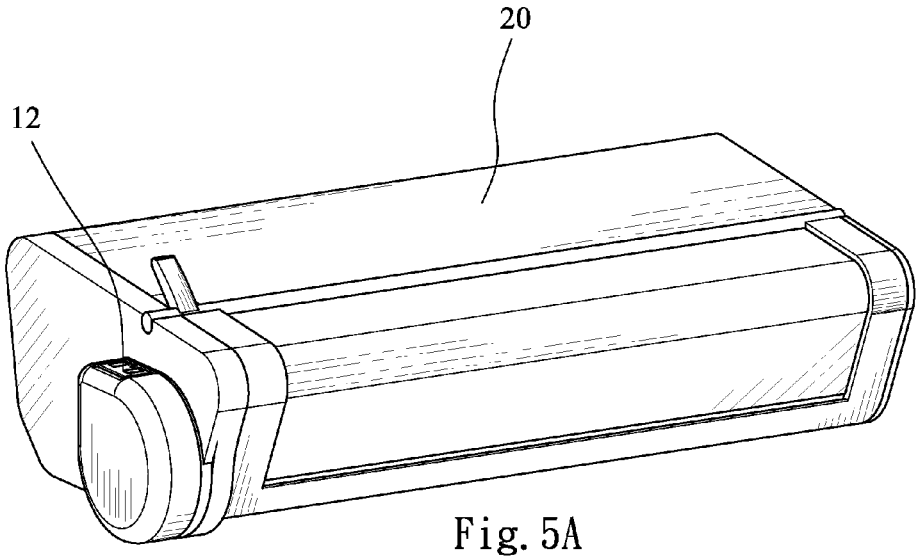
FIG. 5A is a perspective view showing a driving device for a toner cartridge according to a third embodiment of the present invention.
Figure 5B:
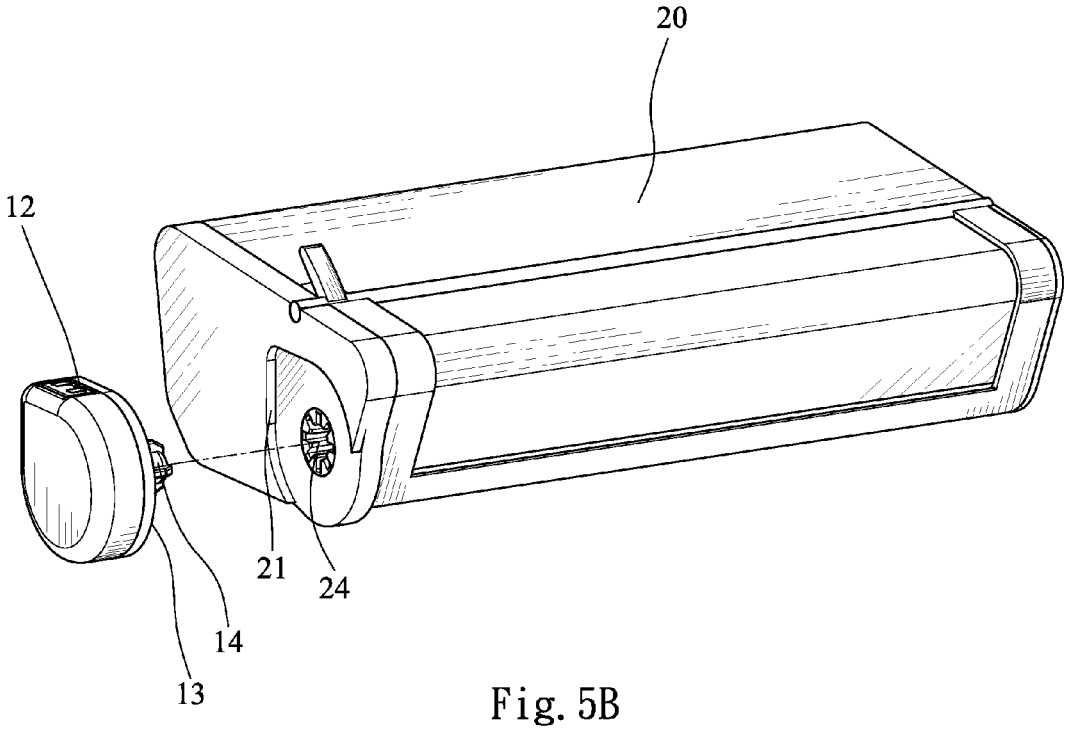
FIG. 5B is a partially exploded view showing the driving device of FIG. 5A.

FIGS. 5A and 5B are perspective views showing a driving device 1 for a toner cartridge according to a third embodiment of the present invention. As shown, the driving portion 10 includes a mount end 13, and one side of the cartridge body 20 includes a mount portion 21 corresponding to the mount end 13. The mount end 13 detachably connects with the mount portion 21, and therefore the driving portion 10 can assemble with and disassemble from the cartridge body 20. Further, the driving motor 10 includes a driving member 14, and the gear 22 includes a sleeve element 24 corresponding to the driving member 14. The driving member 14 can be engaged with and disengaged from the sleeve element 24. When replacing the toner cartridge, the user can replace the cartridge body 20 only and keep using the driving portion 10. It is different from the first embodiment in which the user replaces the whole toner cartridge.

Therefore, the driving device 1 according to the present invention has the following advantages:

1. Because the driving motor 11 of the driving device 1 is disposed on the cartridge body 20, the transmission mechanism of the toner cartridge can be simplified. Accordingly, material wear and power transmission loss due to mechanical interaction can be reduced.

2. Because the driving motor 11 has the controller 12 to connect with the controller unit of the printing apparatus, the motor 11 is controlled to precisely drive the component parts in the toner cartridge to print. Printing quality can thereby be improved.

3. Because the driving motor 11 is disposed on the cartridge body 20, the toner cartridge is, thus, provided with a direct driving capability. The printing apparatus does not need to drive the toner cartridge through complex transmission mechanism. Thus, the driving load of the printing apparatus is reduced, and the stability of the printing is improved.

Although the present invention has been described with reference to the preferred embodiment thereof, it is apparent to those skilled in the art that a variety of modifications and changes may be made without departing from the scope of the present invention which is intended to be defined by the appended claims.

What is claimed is:

1. A toner cartridge having a driving device for use in a printing apparatus, comprising:

a driving portion including a driving motor and a controller electrically connected with the driving motor; and a cartridge body including an imaging drum and a transmission mechanism disposed therein, wherein the driving portion is disposed at an outer side of or in the cartridge body, the driving motor is connected with the imaging drum or the transmission mechanism, the driving motor, the imaging drum, and the transmission mechanism are coaxial to each other and located side by side and outside of each other, and the controller is connected with the printing apparatus for receiving control signals to control an operation of the driving motor.

2. The toner cartridge as claimed in claim 1, wherein the driving portion is mounted to the outer side of the cartridge body, wherein the driving portion comprises a mount end and the cartridge body comprises a mount portion corresponding to the mount end, wherein the mount end of the driving portion is detachably engaged with the mount portion of the cartridge body.

3. The toner cartridge as claimed in claim 2, wherein the driving portion comprises a driving member and the imaging drum comprises a sleeve element corresponding to the driving member, and the driving member detachably engages with the sleeve element, whereby the driving motor is capable of driving the imaging drum.

4. The toner cartridge as claimed in claim 2, wherein the driving portion comprises a driving member and the transmission mechanism comprises a sleeve element corresponding to the driving member, and the driving member detachably engages with the sleeve element, whereby the driving motor is capable of driving the transmission mechanism.

5. The toner cartridge as claimed in claim 1, with the driving portion mounted in the cartridge body, with the transmission member being a gear, with the gear coaxially mounted between the driving motor and the imaging drum.

* * * * *